United States Patent [19]

Keeton

[11] 4,263,880

[45] Apr. 28, 1981

[54] ROTARY ENGINE

[76] Inventor: John H. Keeton, P.O. Box 278, Campbellsville, Ky. 47218

[21] Appl. No.: 759,345

[22] Filed: Jan. 14, 1977

[51] Int. Cl.[3] ..... F02B 57/08

[52] U.S. Cl. ..... 123/44 R; 91/491; 91/498

[58] Field of Search ..... 123/43 R, 44 A, 44 R, 123/8.47; 417/273, 462; 418/187; 91/196, 491; 92/54

[56] References Cited

U.S. PATENT DOCUMENTS

| | | | |
|---|---|---|---|
| 585,090 | 6/1897 | Dyer | 417/273 |
| 868,100 | 10/1907 | Krehbiel | 123/44 R |
| 879,512 | 2/1908 | Braunwalder | 123/44 R |
| 1,990,660 | 2/1935 | McCann | 123/21 |
| 3,043,234 | 7/1962 | Poulin | 123/44 R |
| 3,538,893 | 11/1970 | Tinsley | 123/8.47 X |

*Primary Examiner*—Leonard E. Smith

*Attorney, Agent, or Firm*—Cushman, Darby & Cushman

[57] ABSTRACT

A rotary engine, especially a rotary diesel engine, utilizing a pair of substantially identical cooperating rotor assemblies associated with a pair of spaced, parallel stationary intake-exhaust gas ports. Each rotor assembly includes a hub portion immediately surrounding a stationary shaft, a plurality of arms extending radially outwardly from the hub portion, a radially extending cylinder formed in each of the arms, a radially extending passageway leading from the stationary shaft to each cylinder, and a radially reciprocal piston disposed in each cylinder. The stationary shafts are so spaced and the rotor assembly so mounted that upon rotation of the rotor assemblies each piston associated with each rotor assembly will engage the hub of the other assembly upon completion of the compression stroke of the piston, and then will engage an arm of the other assembly to impart a rotational force to the arm upon radial movement of the piston during a power stroke, the rotor assemblies rotating in opposite. The casings for the rotor assemblies have an internal surface which affects inward radial movement of each piston after completion of power stroke so that gases from the cylinders are exhausted to the intake-exhaust stationary shaft. Axially spaced radially extending cooling fins may be associated with rotor assembly, and in order to minimize deterioration of the stationary shaft and cylinder passageways, the exhaust port formed in the stationary shaft extends more than 90° and the exhaust stroke takes place over an arc of travel of more than 90° during rotation of the rotor assemblies.

4 Claims, 3 Drawing Figures

ROTARY ENGINE

BACKGROUND AND SUMMARY OF THE INVENTION

This invention relates to a rotary internal combustion engine, and in particular a rotary diesel engine. The invention relates to the type of rotary internal combustion engines having a pair of substantially identical rotating members cooperating with a stationary fuel supplying and exhaust gas removing shaft, the rotating members having radially reciprocal piston and cylinder arrangements associated therewith. It is believed that the present invention has several advantages over prior art proposals which advantages make the invention a more practical structure for actual use, especially with diesel engines.

According to the present invention, a large heat transfer area is provided for the rotating members which heat transfer area facilitates cooling of the pistons and cylinders and thereby lengthens the life of the pistons and cylinders under the high temperature conditions normally prevalent in a diesel engine. The large heat transfer area is provided in two different manners—the rotary assemblies include a plurality of arms that extend radially outwardly from a hub portion which surrounds the stationary shaft, and on the radially extendingly arms are provided a plurality of axially spaced, radially extending cooling fins. Additionally, adverse effects on the component parts of the structure due to heat are minimized by providing an arcuate exhaust port in the stationary shafts that extends over a substantial portion of the arc of travel of the rotary devices (more than 90°) and by providing internal surface means that move each piston radially inwardly during the exhaust stroke in a constant gradual manner in order to minimize the adverse effects of the high temperature gases being exhausted on the rotor passageways and the stationary exhaust shaft. Typically, the exhaust stroke is longer than either the intake, compression, or power stroke.

The radially extending arm configuration according to the present invention also has other advantages besides the heat dissipating characteristics thereof. By the provision of radially extending arms instead of small notches formed in rotating wheels (as in U.S. Pat. No. 3,043,234) according to the present invention a much larger surface area is provided for the pistons to act on when imparting rotational forces to the assemblies, which leads to a more efficient transfer of the force from the radially reciprocal pistons to the rotating assemblies. Also, the arm configuration of the rotary assemblies minimizes the number of piston and cylinder arrangements that need be provided in order for efficient operation of the engine, and since the piston and cylinder arrangements are expensive component parts of an engine thereby minimizes the cost of the engine. For instance, the rotary assemblies can be constructed so that only three arms are provided, resulting in a simple yet efficient operable structure.

According to the present invention, a rotary engine is provided comprising a pair of spaced parallel stationary intake-exhaust shafts; a pair of substantially identical rotor assemblies, one assembly mounted for rotation about each of the stationary shafts and each of the assemblies including a hub portion immediately surrounding a stationary shaft, a plurality (i.e. three) of arms extending radially outwardly from the hub portion, a radially extending cylinder formed in each of the arms, a radially extending passageway leading from the stationary shaft to each cylinder, a radially reciprocal piston disposed in each cylinder; means for spacing the stationary shafts and mounting the rotor assembly so that upon rotation of the rotor assemblies each piston associated with each of the rotor assemblies will engage the hub of the other assembly upon completion of the compression stroke of the piston, and then will engage an arm of the other assembly and impart a rotational force thereto upon radial movement of the piston during a power stroke after compression; and casing means associated with the rotor assemblies for effecting radial movement of the pistons after completion of a power stroke so that gases from the cylinders are exhausted to the intake-exhaust stationary shaft. A plurality of axially spaced, radially extending cooling fins are associated with each of the rotor assemblies. Additionally, the remote ends of each of the pistons are arcuate and the termination portions of each of the arms have arcuate portions formed in a continuous arc with the piston when the piston is in its most radially inward position. The intake-exhaust stationary shaft has an arcuate exhaust port formed therein that extends more than 90°, and the casing means has first internal surface means for inwardly radially biasing the pistons after completion of a power stroke to exhaust gases from the cylinders so that the exhaust stroke takes place over an arc of travel of more than 90° during rotation of the rotor assemblies. The casing means may also comprise second internal surface means that allow essentially free radial movement of the pistons during the majority of the intake stroke thereof.

The engine according to the invention is preferably a diesel engine, and a method of driving a power shaft using the rotary diesel engine according to the invention includes the steps of injecting fuel into each cylinder during an intake stroke, inwardly radially moving the piston after injection of fuel into the cylinder to compress the injected fuel until ignition of the fuel takes place by compression of the fuel, during the power stroke of a piston associated with one assembly imparting rotation to the other assembly in a direction opposite to the rotation of the one assembly, and radially inwardly biasing each piston after completion of a power stroke thereby to exhaust gases from the cylinder associated therewith, the radial inward biasing taking place over an arc of more than 90° during rotation of the rotor assemblies, the exhaust stroke being over a greater arcuate travel than either the intake, compression, or power stroke, and the exhausting of gases during the exhaust stroke being gradual during radial inward movement of the piston. These steps are then repeated during constant rotation of the assemblies.

It is the primary object of the present invention to provide a simple operable rotary internal combustion engine, especially a diesel engine. This and other objects of the invention will become clear from an inspection of the detailed description of the invention and from the appended claims.

DETAILED DESCRIPTION OF THE INVENTION

Figure 1:
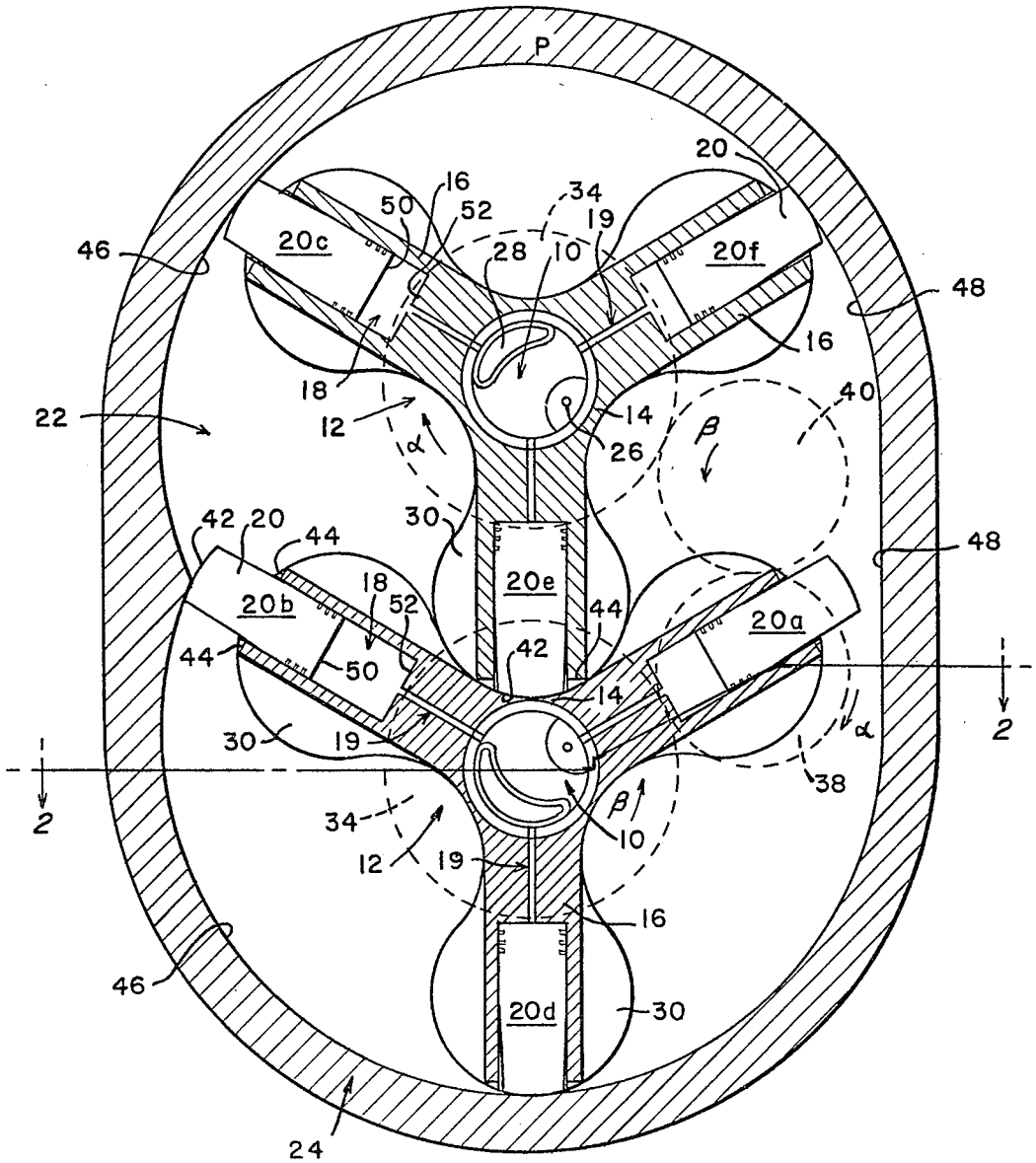
FIG. 1 is a view taken along lines 1—1 of FIG. 2 showing some of the component parts in section and others in elevation.

An exemplary rotary engine according to the present invention is shown schematically in the drawings. The engine comprises a pair of spaced, parallel stationary intake-exhaust shafts 10, and a pair of substantially identical rotor assemblies 12, one assembly mounted for rotation about each of the stationary shafts 10. Each of the assemblies 12 includes a hub portion 14 immediately surrounding the stationary shaft 10, a plurality of arms 16 extending radially outwardly from the hub portion 14, a radially extending cylinder 18 formed in each of the arms 16, a radially extending passageway 19 leading from the stationary shaft 10 to each cylinder 18, a radially reciprocal piston 20 disposed in each of the cylinders 18—each piston during a power stroke and during an intake stroke thereof extends so that an end (42) thereof most remote from the hub portion 14 extends past the axial termination (44) of the arms 16 with which it is associated, and after compression and after an exhaust stroke thereof the remote end (42) thereof is generally flush with the arms 16 axial termination (44). The engine also comprises means 22 for spacing the stationary shafts 10 and mounting the rotor assemblies 12 so that upon rotation of the rotor assemblies 12 each piston 20 associated with each of the rotor assemblies 12 will engage the hub 14 of the other assembly 12 upon completion of the compression stroke of the piston 20, and then will engage an arm 16 of the other assembly 12 and impart a rotational force thereto upon radial movement of the piston 20 during the power stroke after compression, whereby the rotor assemblies 12 rotate in opposite directions $\alpha$ and $\beta$. Casing means 24 associated with the rotor assemblies effect radial movement of the pistons after completion of a power stroke so that gases from the cylinders 18 are exhausted to the intake-exhaust stationary shafts 10.

Each of the stationary shafts 10 includes an inlet port 26 and an arcuate exhaust port 28. The inlet port 26 is connected to fuel injecting means and during the inlet stroke (see piston 20*a*) fuel is injected into the cylinder 18 associated with piston 20*a*. The arcuate exhaust port 28 extends a sufficient arcuate distance so that gases exhausted from cylinders 18 are gradually exhausted through passageways 19 to minimize the adverse effect these hot exhaust gases have on the cylinders, passageways and arms. Piston 20*b* in FIG. 1 is shown at the start of the exhaust stroke, and piston 20*c* is shown partially through the exhaust stroke. The exhaust port 28 extends over at least 90° in order to minimize the adverse effect of the exhaust gases, and preferably the exhaust stroke is of longer duration (greater arcuate extent) than the intake, compression, or power strokes. The fact that the members which define the pistons are in the form of arms 16 facilitate gradual exhausting of hot exhaust gases from the cylinders 18 by minimizing the number of piston and cylinder assemblies that are necessary (i.e., only three arms are provided) so that the exhaust port can be made to have a great arcuate extent yet two different passageways 19 are not in complete operative engagement therewith. Additionally, the casing means 24 are so formed that even after movement of a piston to its most radially inward position during the exhaust stroke (see piston 20*d* in FIG. 1) the piston is still biased radially inwardly until it passes the exhaust port 28 whereby no exhaust gases being exhausted from the cylinder associated with piston 20*b* can be expelled into the cylinder associated with piston 20*d*. This particular relationship between the exhaust port 28 and the cylinders 18 and the casing means 24 means that the exhaust port need not necessarily be connected to a large vacuum so that the rapid sucking out of gases from the cylinders 18 will not occur but rather only gradual exhausting thereof upon radial movement of the pistons 20.

The arm configuration of the rotating assemblies 12 also facilitates heat transfer between the assemblies and the surrounding environment in the casing means 24 since large surface areas are provided. To further enhance the heat transferring capabilities of the arms 16 a plurality of axially spaced (see FIG. 2) radially extending cooling fins 30 are provided associated with each arm 16.

Figure 2:
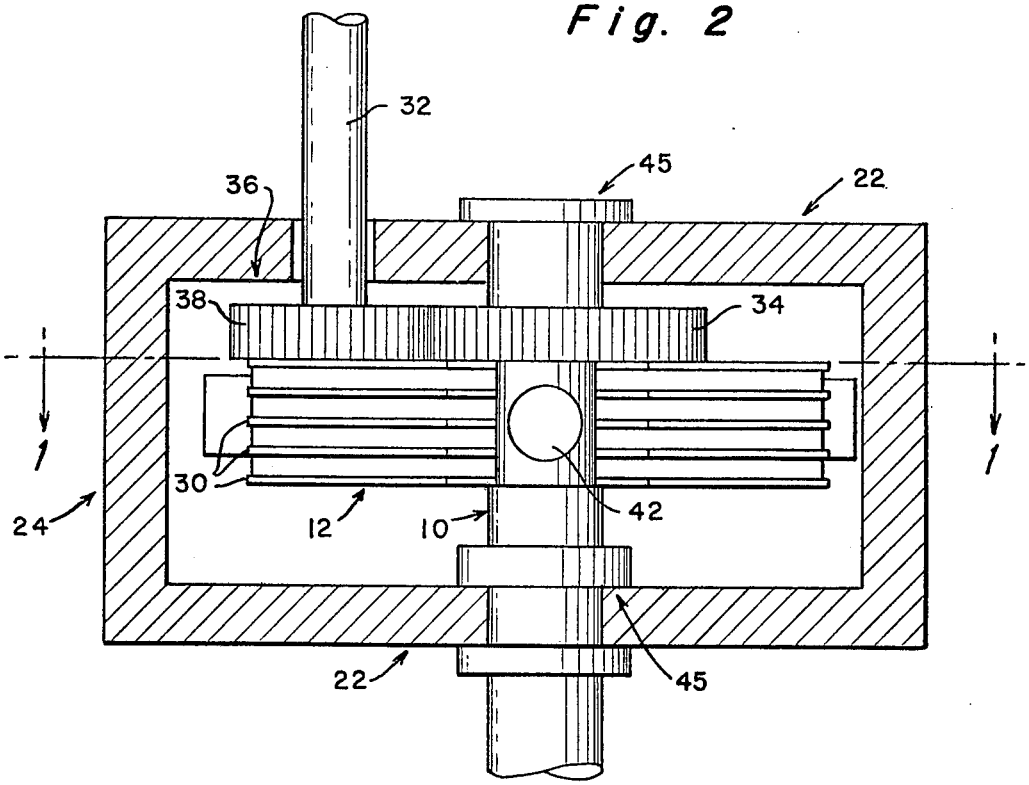
FIG. 2 is a view taken along lines 2—2 of FIG. 1 showing some of the component parts in section and others in elevation.
Figure 3:
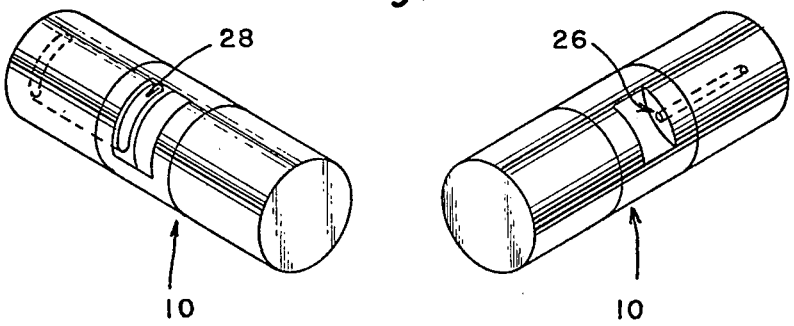
FIG. 3 is a component part perspective view showing both the intake port and exhaust port of an exemplary stationary shaft utilizable with this invention.

Power is taken from the rotating assemblies 12 by a common power shaft 32 (see FIG. 2). The power shaft 32 extends axially with respect to the assemblies 12, and a pair of gear members 34 (see FIG. 2 and the dotted line representation in FIG. 1) rotatable with the rotor hub portions 14 supply the power to the power shaft through gear means 36 associated with the power for imparting unidirectional rotation to the power shaft from the opposite directional rotations of the rotor assemblies 12. The gear means 36 includes a first gear 40 directly connected to the power shaft 32 (see FIG. 2) and a second gear 38 (see dotted line configuration in FIG. 1) engaging both first gear 38 and the gear member 34 associated with the rotating assembly 12 opposite the rotating assembly associated with first gear 38. First gear member 40 rotates in direction $\beta$ while first gear member 38 rotates in direction $\alpha$, second gear member 40 being powered both by gear member 34 and gear 38.

The remote ends 42 of the pistons 20 preferably are formed so that they have an arcuate configuration so that they better conform to the curvature between the arms 16 and hub portion 14 of the rotary assemblies, the degree of curvature of the arcuate portions 42 of the pistons corresponding to the degree of curvature between arm member 16 of the hub portion 14 (see piston 20*e* in FIG. 1). Additionally, the radially remote ends of the arms 16 preferably have terminating portions 44 thereof that are also arcuate and have the same degree of curvature as the ends 42 of the pistons so that a proper fit is provided between the arms 16, the pistons 20 and the hub portions 14 during rotation of the rotary assemblies, and so that the ends 42 of the pistons provide a substantially continuous surface with the ends of the arms 16.

The means 22 for spacing the stationary shafts and mounting the rotary assembly so that the radially longitudinal movement of the pistons 20 will be transferred to rotational movement of the opposite assemblies 12 comprises the top and bottom portions of the casing means 24, the means 22 having bushings 45 associated therewith for mounting the shafts 10 and the rotary assemblies 12 thereon.

The casing means 24 has first and second internal surface means 46 and 48, respectively, associated therewith. The first internal surface means 46 inwardly radially biases the pistons after completion of a power stroke to exhaust gases from the cylinders 18 so that the exhaust stroke takes place over an arc of travel of more than 90° during rotation of the rotor assemblies. As can be seen comparing the relative radial positions of the pistons 20*c* and 20*f* in FIG. 1 which are equidistant from point P, the means 46 retains the bias of the pistons 20 in the fully inward position so that cylinder inner end 50 is maintained in abutting engagement with piston inner end 52 even after that abutting position has been reached (the abutting position being shown by piston 20*d* in FIG. 1). The second internal surface means 48 is designed to allow essentially free radial movement of each piston 20 (see piston 20*a* in FIG. 1) during the majority of the intake stroke thereof during which the passageway 19 of a cylinder 18 cooperates with the intake port 26. After each cylinder is filled with the right amount of fuel mixture from the intake port 26 and the fuel injection means associated therewith, the compression stroke is started by the movement of the ends 42 of each piston 20 into engagement with an arm 16 and hub portion 14 of the opposed rotary assembly 12. The provision of the relatively long arms 16 for the rotary assemblies 12 potentially increases the efficiency of the transfer of rotational force from the piston undergoing the power stroke to the other rotary assembly 12. A few relatively large pistons may be provided according to the present invention rather than a large number of small pistons which can result in reduced overall costs for the rotary assemblies in addition to the heat transfer advantages previously mentioned.

Additionally, according to the present invention, a method of driving a power shaft with a rotary diesel engine is provided. The rotary diesel engine includes a pair of spaced, parallel stationary intake-exhaust shafts, each of the shafts having an arcuate exhaust port formed therein extending over an arc of greater than 90°; a pair of substantially identical rotor assemblies, each assembly having a plurality of radially extending cylinders formed therein, each cylinder having a radially reciprocal piston, the pistons on one assembly cooperating with the other assembly to impart a rotational force thereto upon radial movement of the piston during a power stroke; and casing means for radially inwardly biasing each piston after a power stroke through exhaust gases therefrom. The method comprises the steps of injecting fuel mixture into each cylinder during an intake stroke thereof during rotation of the rotor assemblies, inwardly radially moving the piston 20 after injection of fuel mixture into the cylinder 18 associated therewith to compress the injected fuel until ignition of the fuel takes place by compression of the fuel mixture, during a power stroke of a piston 20 associated with one assembly 12 imparting rotation to the other assembly 12 in a direction ($\beta$) opposite the direction of rotation ($\alpha$) of the one assembly, radially inwardly biasing each piston 20 after completion of a power stroke thereby to exhaust gases from the cylinder 18 associated therewith, the radial inward biasing taking place over an arc of more than 90° during rotation of the rotor assemblies, the exhaust stroke being over a greater arcuate travel than either the intake, compression or power stroke, and exhausting of gases during the exhausting stroke being gradual during radially inward movement of the piston, and repeating the above steps during constant rotation of the assemblies to drive a power shaft.

It will thus be seen that according to the present invention a rotary internal combustion engine has been provided—especially a rotary diesel engine—that has various heat transfer, cost, and power transfer advantages. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims claims so as to encompass all equivalent structures and methods.

What is claimed is:

1. a method of driving a power shaft with a rotary diesel engine including a pair of spaced, parallel stationary intake-exhaust shafts, each of the shafts having an arcuate exhaust port formed therein extending over an arc of greater than 90°; a pair of substantially identical rotor assemblies operatively connected to a common power shaft, each assembly having a plurality of radially extending cylinders formed therein, each cylinder having a radially reciprocal piston, the pistons of one assembly cooperating with the other assembly to impart a rotational force thereto upon radial movement of the piston during a power stroke; and casing means for radially inwardly biasing each piston after a power stroke to exhaust gases therefrom, said method comprising the steps of (a) injecting fuel into each cylinder during an intake stroke thereof during rotation of the rotor assemblies, (b) inwardly radially moving the piston after injection of fuel into the cylinder associated therewith to compress the injected fuel until ignition of the fuel takes place by compression of the fuel, (c) during the power stroke of a piston associated with one assembly imparting rotation to the other assembly in a direction opposite the direction of rotation of the one assembly, (d) radially inwardly biasing each piston after completion of a power stroke thereby to exhaust gases from the cylinder associated therewith, the radial inward biasing taking place over an arc of more than 90° during rotation of the rotor assemblies, the exhaust stroke being over a greater arcuate travel than either the intake, compression, or power stroke, and exhausting of gases during the exhaust stroke being gradual during radially inward movement of the piston, and (e) repeating steps (a)–(d) during constant rotation of the assemblies to power the power shaft.

2. A rotary engine comprising:

(a) a pair of spaced, parallel stationary intake-exhaust shafts, each having an arcuate exhaust port formed therein which extends more than 90°;

(b) a pair of substantially identical rotor assemblied, one assembly mounted for rotation about each of said stationary shafts and each of said assemblies including (i) a hub portion immediately surrounding a stationary shaft, (ii) a plurality of arms extending radially outwardly from said hub portion, (iii) a radially extending cylinder formed in each of said arms, (iv) a radially extending passageway leading from said stationary shaft to each cylinder (v) a radially reciprocal piston disposed in each of said cylinders, each piston during a power stroke and during an intake stroke thereof extending so that an end thereof most remote from said hub portion extends past the axial termination of the arm with which it is associated, and after compression and after an exhaust stroke thereof having said remote end thereof generally flush with said arm axial termination; the remote end of each of said pistons being arcuate and the terminations of each of said arms having arcuate portions forming a continuous arc with said piston end when said piston is in its most radially inward position;

(c) means for spacing said stationary shafts and mounting said rotor assemblies so that upon rotation of said rotor assemblies each piston associated with each of said rotor assemblies will engage the hub of the other assembly upon completion of the compression stroke of the piston, and then will engage an arm of the other assembly and impart a rotational force thereto upon radial movement of the piston during a power stroke after compression, so that said rotor assemblies rotate in opposite directions; and (d) casing means associated with said rotor assemblies for effecting radial movement of said pistons after completion of a power stroke so that gases from said cylinders are exhausted to said intake-exhaust stationary shaft, said casing means having first internal surface means for gradually inwardly radially biasing said pistons after completion of a power stroke to exhaust gases from said cylinders so that the exhaust stroke takes place gradually over an arc of travel of more than 90° during rotation of said rotor assemblies; said casing means engaging said piston remote ends in their most radially inward positions.

3. A rotary engine comprising:

(a) a pair of spaced, parallel stationary intake-exhaust shafts, each having an arcuate exhaust port formed therein which extends more than 90°;

(b) a pair of substantially identical rotor assemblied, one assembly mounted for rotation about each of said stationary shafts and each of said assemblies including (i) a hub portion immediately surrounding a stationary shaft, (ii) a plurality of arms extending radially outwardly from said hub portion, (iii) a radially extending cylinder formed in each of said arms, (iv) a radially extending passageway leading from said stationary shaft to each cylinder (v) a radially reciprocal piston disposed in each of said cylinders, each piston during a power stroke and during an intake stroke thereof extending so that an end thereof most remote from said hub portion extends past the axial termination of the arm with which it is associated, and after compression and after an exhaust stroke thereof having said remote end thereof generally flush with said arm axial termination;

(c) means for spacing said stationary shafts and mounting said rotor assemblies so that upon rotation of said rotor assemblies each piston associated with each of said rotor assemblies will engage the hub of the other assembly upon completion of the compression stroke of the piston, and then will engage an arm of the other assembly and impart a rotational force thereto upon radial movement of the piston during a power stroke after compression, so that said rotor assemblies rotate in opposite directions; and (d) casing means associated with said rotor assemblies for effecting radial movement of said pistons after completion of a power stroke so that gases from said cylinders are exhausted to said intake-exhaust stationary shaft, said casing means having first internal surface means for gradually inwardly radially biasing said pistons after completion of a power stroke to exhaust gases from said cylinders so that the exhaust stroke takes place gradually over an arc of travel of more than 90° during rotation of said rotor assemblies, and said casing means comprising second internal surface means that allow radial movement of said pistons unrestrained by surface means during the majority of the intake strokes thereof.

4. A diesel rotary engine comprising (a) a pair of spaced, parallel stationary intake-exhaust shafts, each of said shafts having an arcuate exhaust port formed therein extending over an arc of greater than 90°, and each of said stationary shafts having an arcuate inlet port and fuel injection means associated with said inlet port;

(b) a pair of substantially identical rotor assemblies, each assembly having a plurality of radially extending cylinders formed therein, each cylinder having a radially reciprocal piston disposed therein, and a radially extending passageway associated with each of said cylinders extending from said stationary shaft to the respective cylinder;

(c) means for spacing said stationary shafts and mounting said rotor assemblies so that upon rotation of said rotor assemblies each piston associated with each rotor assembly will engage the other rotor assembly and impart a rotational force thereto upon radial movement of the piston during a power stroke so that said rotor assemblies rotate in opposite directions; and (d) casing means associated with said rotor assemblies for effecting radial movement of said pistons after completion of a power stroke thereby to exhaust gases from said cylinders to said exhaust port in said stationary shaft, said casing means including first internal surface means for gradually inwardly radially biasing said pistons so that the exhaust stroke takes place gradually over an arc of travel of more than 90° during rotation of said rotor assemblies, and said casing means including second internal surface means for allowing radial movement of said pistons unrestrained by surface means during the majority of the intake stroke thereof.

* * * * *